US011761111B2

(12) United States Patent
Andreae et al.

(10) Patent No.: US 11,761,111 B2
(45) Date of Patent: Sep. 19, 2023

(54) SYSTEM AND METHOD FOR COATING THIN ELONGATE PARTS

(71) Applicant: SST Systems, Inc., Sturgeon Bay, WI (US)

(72) Inventors: Bradley M. Andreae, Sturgeon Bay, WI (US); Joseph Wildenberg, Brussels, WI (US); Anthony C. Scoville, Sturgeon Bay, WI (US)

(73) Assignee: SST Systems, Inc., Sturgeon Bay, WI (US)

( * ) Notice: Subject to any disclaimer, the term of this patent is extended or adjusted under 35 U.S.C. 154(b) by 67 days.

(21) Appl. No.: 17/307,930

(22) Filed: May 4, 2021

(65) Prior Publication Data

US 2021/0348295 A1 Nov. 11, 2021

Related U.S. Application Data

(60) Provisional application No. 63/156,234, filed on Mar. 3, 2021, provisional application No. 63/020,783, filed on May 6, 2020.

(51) Int. Cl.
*C25D 17/06* (2006.01)
*C25D 5/50* (2006.01)

(52) U.S. Cl.
CPC ..... *C25D 17/06* (2013.01); *C25D 5/50* (2013.01)

(58) Field of Classification Search
None
See application file for complete search history.

(56) References Cited

U.S. PATENT DOCUMENTS 1,336,928 A 4/1920 Simmons
1,950,096 A * 3/1934 Yeager ..... C25D 5/02 204/297.08
2,213,014 A 8/1940 Owen
3,566,891 A * 3/1971 Koch, II ..... B65G 49/045 118/421
3,831,736 A 8/1974 Barnes
4,534,843 A * 8/1985 Johnson ..... C25D 17/06 204/224 R (Continued)

FOREIGN PATENT DOCUMENTS

CN 110668083 * 1/2020 ..... B65G 17/20
JP S5941497 * 3/1994 ..... C25D 13/00

(Continued)

*Primary Examiner* — Stefanie S Wittenberg
(74) *Attorney, Agent, or Firm* — Michael Best & Friedrich LLP

(57) ABSTRACT

In one aspect, the invention provides a coating process system including a continuous conveyor, a first end defining a loading station for loading work pieces to the conveyor, and a second end defining an unloading station for unloading work pieces from the conveyor. A series of workstations is configured to render coated work pieces and arranged at a first level to extend between the first and second ends. A cure oven is arranged at a second level above the first level, the conveyor making a plurality of runs between the first and second ends at different sub-levels within the second level. A first post-oven run of the conveyor extends from an outlet of the cure oven to the unloading station. A second post-oven run of the conveyor extends from the unloading station to the loading station.

25 Claims, 11 Drawing Sheets

(56) References Cited

U.S. PATENT DOCUMENTS

| | | | | | |
|---|---|---|---|---|---|
| 4,812,211 | A * | 3/1989 | Sakai | C25D 13/22 204/287 |
| 5,299,681 | A | 4/1994 | Kadono et al. | |
| 5,379,880 | A | 1/1995 | Stone et al. | |
| 5,578,126 | A | 11/1996 | Taga et al. | |
| 5,673,540 | A | 10/1997 | Sanukiya et al. | |
| 5,871,084 | A | 2/1999 | Kasik | |
| 6,000,688 | A | 12/1999 | Giangrasso | |
| 2003/0005885 | A1 * | 1/2003 | Mueller | B65G 49/0459 29/25.01 |

FOREIGN PATENT DOCUMENTS

| | | | | |
|---|---|---|---|---|
| JP | H06146083 | * | 5/1994 | C25D 17/06 |
| JP | H11195639 | * | 7/1999 | C25D 17/00 |
| JP | 2011214035 | * | 10/2011 | C23C 2/02 |

* cited by examiner

SYSTEM AND METHOD FOR COATING THIN ELONGATE PARTS

CROSS-REFERENCE TO RELATED APPLICATIONS

This application claims priority to U.S. Provisional Patent Application No. 63/020,783 filed on May 6, 2020, and to U.S. Provisional Patent Application No. 63/156,234 filed on Mar. 3, 2021, the entire contents of both of which are incorporated by reference herein.

BACKGROUND

The present invention relates to finishing systems and processes for manufactured parts, and more particularly to carriers for transporting manufactured parts through a finishing process and methods relating to the same.

SUMMARY

In one aspect, the invention provides a coating process system including a continuous conveyor, a first end defining a loading station for loading work pieces to the conveyor, and a second end defining an unloading station for unloading work pieces from the conveyor. A series of workstations is configured to render coated work pieces and arranged at a first level to extend between the first and second ends. A cure oven is arranged at a second level above the first level, the conveyor making a plurality of runs between the first and second ends at different sub-levels within the second level. A first post-oven run of the conveyor extends from an outlet of the cure oven to the unloading station. A second post-oven run of the conveyor extends from the unloading station to the loading station.

In another aspect, the invention provides a coating process system including a series of workstations configured to prepare and coat a work piece suspended from a continuous conveyor extending along the series of workstations. A loading station is provided at which the work piece is coupled to the conveyor at an upstream end of the series of workstations. A cure oven has an inlet located adjacent a downstream end of the series of workstations along the conveyor, the cure oven extending above the series of workstations. The conveyor makes a plurality of sequential, back-and-forth runs where each run extends across the cure oven at a different height. An unloading station is provided at which the work piece is removed from the conveyor. A post-oven run of the conveyor extends from the unloading station to the loading station.

In yet another aspect, the invention provides a coating process system including a continuous conveyor and a series of workstations arranged along a path of the conveyor and configured to prepare and coat a work piece carried by the conveyor. The series of workstations defines a length measured between respective upstream and downstream ends thereof. A cure oven has an inlet located adjacent the downstream end of the series of workstations along the conveyor, the cure oven extending over top of the series of workstations. Measured parallel to the length of the series of workstations, the cure oven defines a length no more than 1.1 times the length of the series of workstations. The conveyor makes at least three lengthwise runs through the cure oven at different heights such that, for any given conveyor speed, a residence time of the work piece in the cure oven is more than double a total residence time within the series of workstations.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
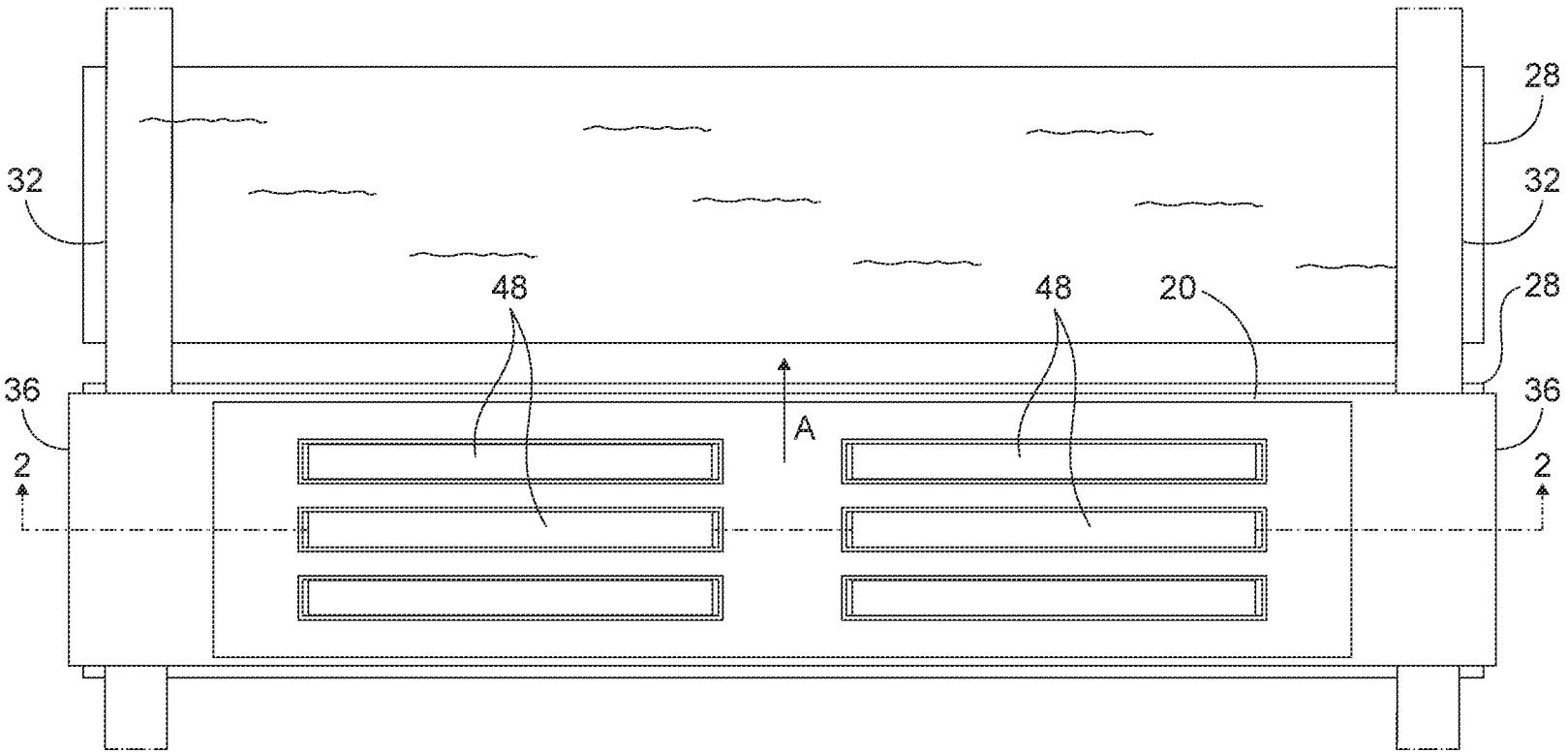
FIG. 1 is a plan view cross-section of a magnetic work piece carrier according to a first embodiment of the present disclosure.
Figure 2:
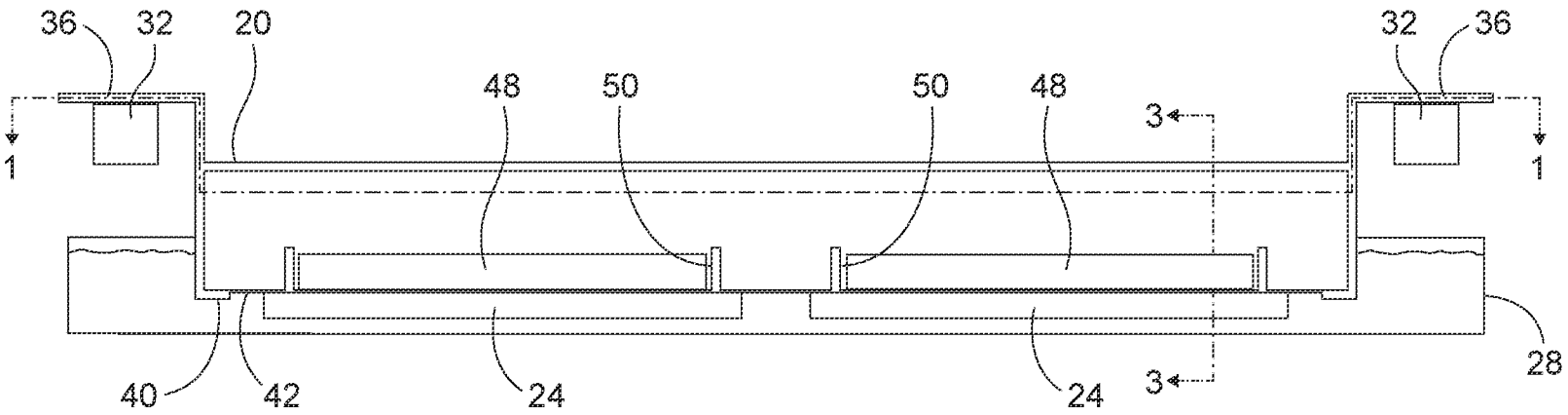
FIG. 2 is a front view cross-section of the magnetic work piece carrier of FIG. 1.
Figure 3:
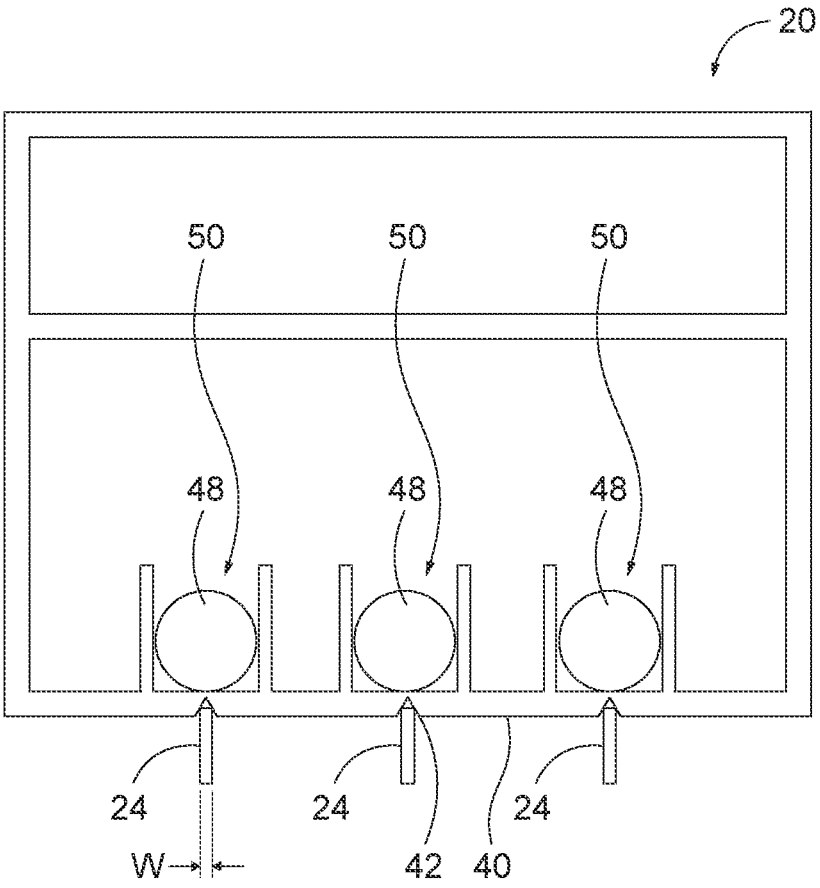
FIG. 3 is a side view cross-section of the magnetic work piece carrier of FIGS. 1 and 2.

A work piece carrier 20 or "holder" is illustrated in FIGS. 1-3. The carrier 20 can be a single piece or an assembly of multiple pieces adapted to hold one or a plurality of work pieces 24, and further adapted to be conveyed through multiple workstations 28 of an industrial process such as a coating process. Although not shown, the carrier 20 can include one or more load bars configured to be engaged by a conveyor as part of a conveyor system, e.g., an overhead conveyor and more particularly an indexing conveyor, as the coating or other process can be a conveyorized process. As illustrated, the conveyor can include one or more rails 32 that extend along a primary direction of travel A. In some constructions, the conveyor can be a SlideRail Square Transfer system such as that provided by SST Systems, Inc. of Sturgeon Bay, Wis. and according to aspects of the disclosure of U.S. Pat. Nos. 5,012,918 and/or 4,942,956, the entire contents of which are incorporated by reference herein. The carrier 20 includes one or more conveyor interfaces 36 so that the conveyor can engage and transport the carrier 20. As illustrated, these conveyor interfaces 36 are provided as horizontal flanges. One or more of the workstations 28 can include liquid baths into which the work pieces 24 and at least a portion of the carrier 20 are immersed during the process of applying a finish coating (e.g., paint) to the work pieces 24. The process can be an electrocoat or "e-coat" process by which electric charge attraction is used to apply suspended paint particles (resin and pigment) from the liquid bath onto the exposed (and electrically-conductive) surface of the work pieces 24. In other constructions, the carrier 20 or a modified form thereof may be used in other surface finish or coating processes, such as without limitation, liquid spray paint, powder coating, or electroplating.

Each work piece 24 is supported by the carrier 20 in fixed relationship therewith, without any means of clamping, gripping, or grasping. The work pieces 24 can be supported "on-edge" along a support surface 40 of the carrier 20. The support surface 40 extends horizontally and forms a bottom surface of the carrier 20 as illustrated, with the work piece 24 suspended from the support surface 40. However, the work pieces 24 can be coupled to any one of a top, bottom, or side of the carrier 20 (e.g., horizontal, vertical, or angled). The support surface 40 of the carrier 20 can include one or more predetermined receptacles or locators 42 in the form of pockets, notches, or slots for receiving a portion, in particular an edge (and more particularly a thinnest edge), of each work piece 24. In the illustrated construction, the work pieces 24 are coupled to the carrier 20 exclusively by magnetic attraction. The carrier 20 has an interior compartment 46 in which one or more magnets 48 are provided. The magnets 48 can be permanent magnets (e.g., Neodymium, such as AH series high temperature Neodymium available from Magma Magnetic Technologies Ltd.). However, it may be possible in some constructions to provide electromagnet (s) that can be powered on and off to selectively generate a magnetic field. High temperature magnets 48 may facilitate further conveyance of the work pieces 24 with the carrier 20 through a heated workstation (e.g., an industrial oven or conveyor oven) for drying/curing the applied coating as part of the coating process. Oven temperatures may be in excess of 300 degrees Fahrenheit, and in some constructions up to at least 400 degrees Fahrenheit. The magnets 48 can be cylindrical in cross-section. Each magnet 48 can be held in a pocket or receptacle 50, or otherwise fixed in place (e.g., with fasteners and/or adhesive) to define an attachment location for one or more work pieces 24. As shown, the receptacles 50 are formed by upstanding walls extending up from the bottom wall of the holder 20 that forms the support surface 40, although the receptacles can alternately by formed by depressions or combinations thereof. Although merely exemplary, the receptacles 50 are laid out in a pattern of two parallel rows of three each along the conveyor direction A. The central axis of each cylindrical magnet 48 can be oriented parallel to the support surface 40 so that the cylinder is lying down along the inside of the carrier wall forming the support surface 40, rather than standing up from it. Thus, the magnetic field is concentrated along a linear path directly below the magnet 48.

Figure 4:
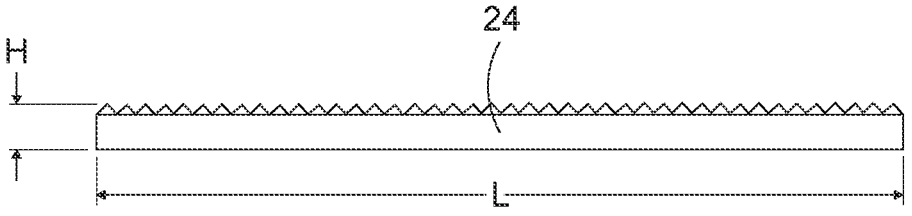
FIG. 4 is a front view of an exemplary work piece.
Figure 6:
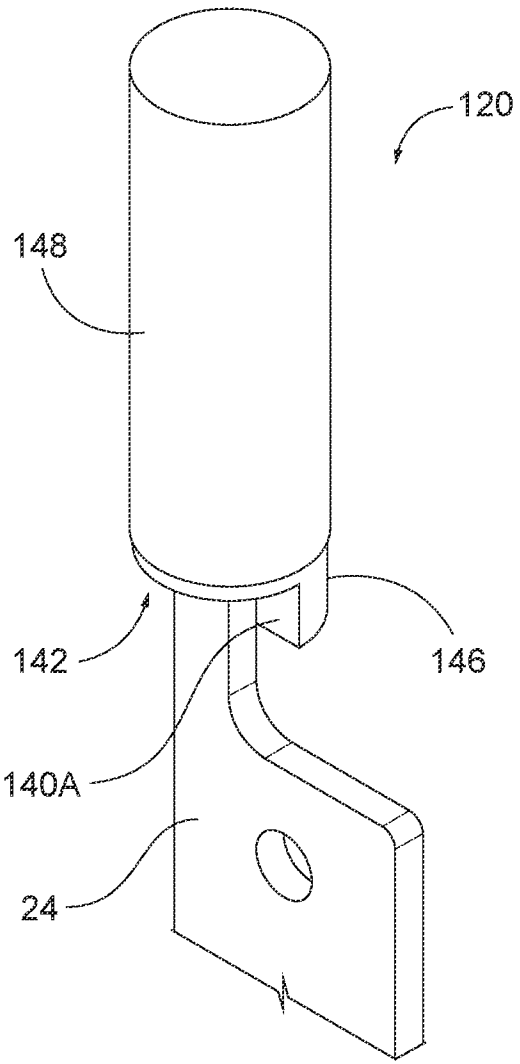
FIG. 6 is a second perspective view of the magnetic work piece carrier of FIG. 5.
Figure 5:
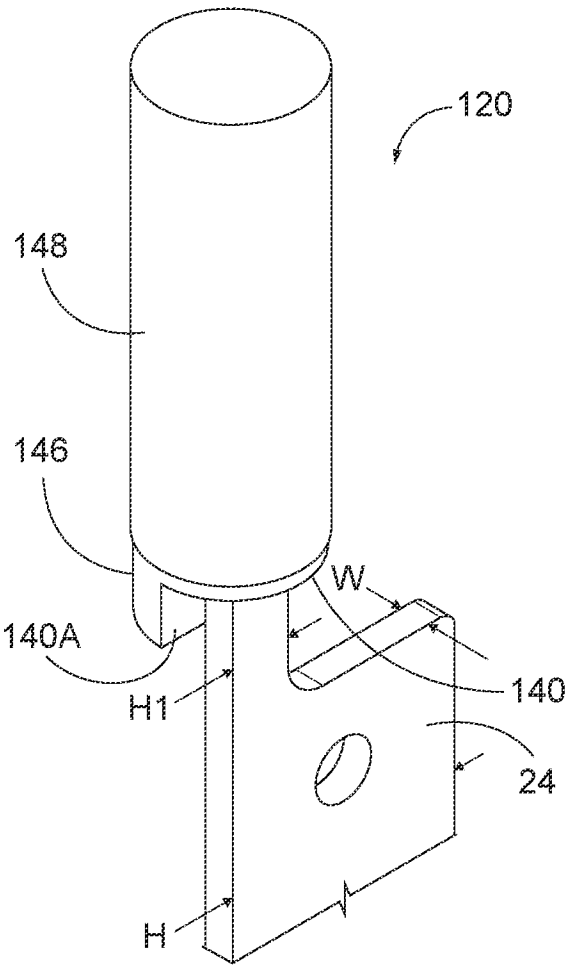
FIG. 5 is a first perspective view of a magnetic work piece carrier according to a second embodiment of the present disclosure.
Figure 8:
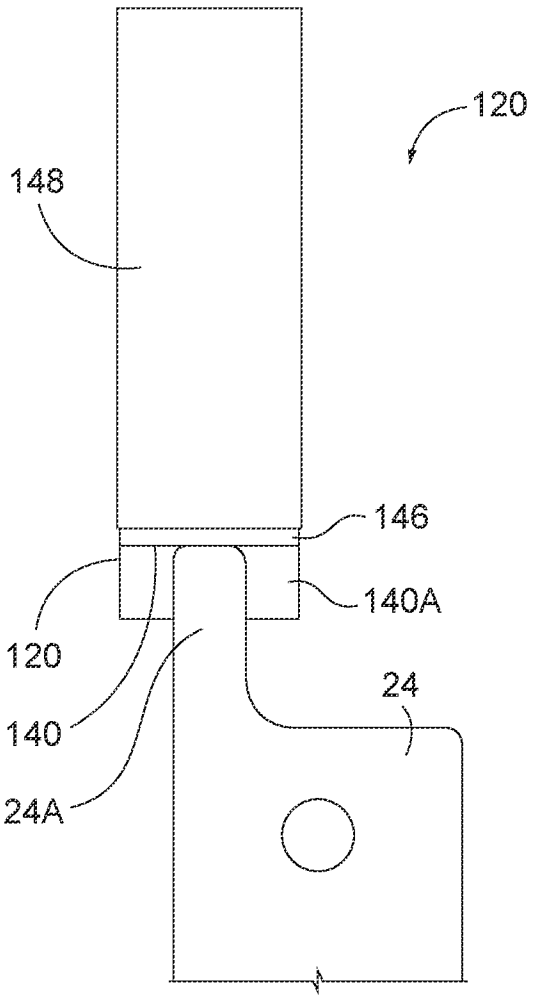
FIG. 8 is a side elevation view of the magnetic work piece carrier of FIG. 5.
Figure 7:
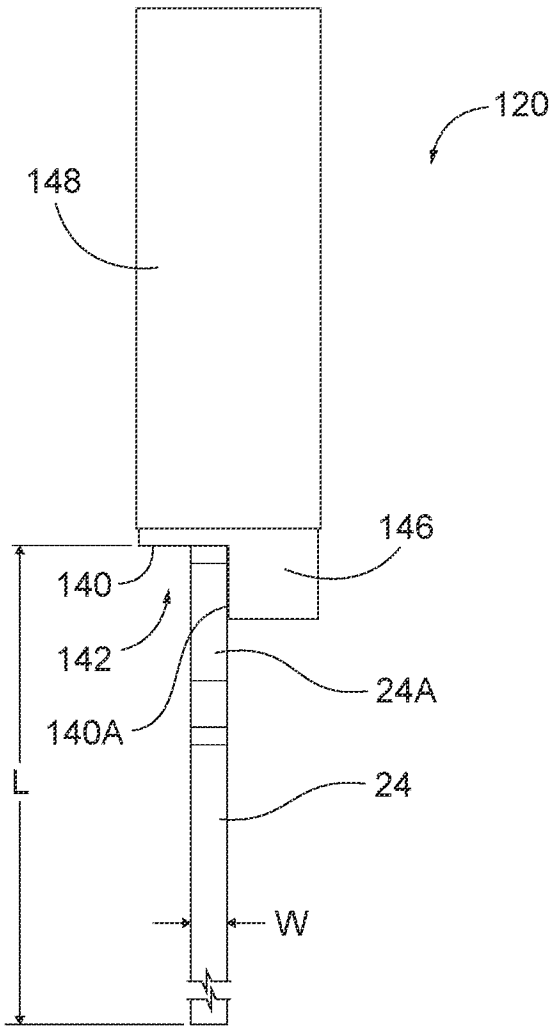
FIG. 7 is a front view of the magnetic work piece carrier of FIG. 5.

The work pieces 24, one of which is shown separate from the carrier 20 in FIG. 4, are thin elongate parts having a length L, a width W, and a height H. The width W and the height H make up the cross-sectional shape or height-to-width ratio, taken in the plane perpendicular to the length L. The cross-section can be uniform along the length L as shown, or may vary through portions thereof. The length L may be the longest dimension by a factor of at least 3 in some constructions. The work piece 24 has a thin cross section in which the height H is substantially larger than the width W. For example, the height-to-width ratio can be 6:1 or greater, such as 8:1 or greater, or 10:1 or greater. The height-to-width ratio may be less than 25:1 in some constructions. Although the work piece width W can be less than 12 mm, and less than 6 mm in some constructions, the term "thin" is not used in reference to the actual measure of size, but comparative dimensional size. Said another way, the work pieces 24 are flat or sheet-form. Two opposite flat sides of the sheet are formed by the length L and the height H, and the work pieces 24 would normally only be stably supported by lying on one of the flat sides as compared to being stood up on-edge, which yields instability. As shown in the drawings, the work pieces 24 engage with the carrier 20 along a thin edge of the work piece 24 formed by the width W and the length L, while the height H of the work piece 24 extends away from the support surface 40 (e.g., perpendicular). Each work piece 24 can have a length L that is the same as, smaller than, or larger than the corresponding magnet length as shown in FIG. 2. As shown in FIG. 3, the width W of the work piece 24 can be less than the corresponding magnet width (e.g., diameter).

Returning to the locators 42 in the support surface 40 of the carrier 20, these locators 42 can be formed with a length that is at least as long as the work piece length L. The locators 42 can accommodate a range of different lengths of work pieces up to the length of the locators 42 themselves. Further, the width of the locators 42 may taper along the depth direction, for example in a "U" or "V" shape as viewed in the cross-section of FIG. 3. By tapering down the width of the notches forming the locators 42, work pieces of various widths W may be accommodated. The various work pieces 24 will be received to a depth corresponding to their width W, while making contact with both side walls in any case. It is also further noted that the width W of some or all work pieces 24 may taper down toward the edge that is held in the locator 42. Thus, the edge of the work piece 24 may be at least partially complementary to the shape of the locator 42 in cross-section. In some constructions, the work pieces 24 are cutting blades having cutting edges (e.g., serrated) that are subject to wear during use and need not be completely coated by the coating process, as the coating would be worn off upon use. Thus, holding the cutting edge against the support surface 40 is not necessarily a detriment to the outcome of the coating process for the work piece 24. Serrations or teeth of a cutting blade may be entirely received into the locator 42 or only partially received therein. Although the deepest portion of each locator 42 can be a straight line at even depth as illustrated, it is also contemplated to have an undulating or serrated shape within the locators 42. Restraining each work piece 24 to the carrier 20 solely by magnetic attraction along the thin edge allows the entire remaining surface of the work piece 24 to be exposed to be coated completely and evenly without any touch points. As shown in FIG. 3, a vast majority of the height H of the work piece 24 is exposed and stands proud of the support surface 40 (e.g., at least 80 percent, at least 90 percent).

The workstations 28 can include finishing stations, including an electrocoating immersion tank for submerging the work pieces 24 into an electrocoating liquid. However, the workstations 28 can also include other types of equipment, such as an oven, a paint or powder coat spray station, and the like. An exemplary electrocoating process line can include a pretreat workstation, followed by an electrocoat workstation, followed by a post rinse workstation, followed by a drying/curing workstation along the conveyor. The work pieces 24 can remain connected to the carrier 20 throughout the entire process. The work pieces 24 remain untouched from the beginning of the finishing process until after drying/curing so there is no concern of contaminating or spoiling the surface coating. During electrocoating, the work pieces 24 are electrically grounded to receive the charged coating particles from the liquid bath. In order to prevent the need for any separate grounding connection placed on the surface of the work pieces 24, the work pieces 24 are grounded through contact with the carrier 20. In particular, physical contact between the electrically conductive work pieces 24 and the electrically conductive carrier 20 establishes ground connection. Both the carrier 20 and the work piece 24 can be wholly or at least partially constructed of metal, and the work piece 24 (or at least a portion thereof) is ferromagnetic metal to exhibit attraction to the magnet 48. Contact between the edge of the work piece 24 and the support surface 40 at the locator 42, including nominal scraping during loading/unloading (and potential micro-movements during the process) prevents the buildup of the coating material within the locator 42. Thus, the carrier 20 may be used and re-used with little or no dedicating cleaning or coating removal, allowing subsequent sets of work pieces 24 to establish electrical grounding connection with the carrier 20.

A process of conveying one or more work pieces 24 through a finishing process can include the following steps. First, the work piece 24 is/are secured to the carrier 20. This involves placement of the work piece(s) 24 into the locators 42, either manually or preferably through an automated handling process, e.g., by registering the carrier 20 with a work piece holding cartridge or tray and then performing a joining movement. The conveyor is operated to transport the carrier 20 with the work pieces 24 to a workstation 28. The conveyor may transport the work pieces 24 directly into the workstation 28 along the primary direction of travel A, or may first transport the work pieces 24 to a position above the workstation 28 (e.g., in the case of an immersion tank). A vertical drive may lower the carrier 20 from the conveyor so that the work pieces 24 are lowered into the workstation 28. The vertical drive can include any suitable system for producing the required vertical travel. Alternately, the conveyor may follow a path that descends to allow the work pieces 24 to descend into the workstation 28. The work pieces 24 can be lowered while traveling along the conveyor or after stopping at a position along the conveyor corresponding to the desired workstation 28. The carrier 20 is then transported via the conveyor to another workstation 28 or to an unloading station of the conveyor system. The work pieces 24 are only removed from the carrier 20 after drying/curing of the applied coating.

FIGS. 5-8 illustrate another embodiment according to aspects of the present disclosure. In this embodiment, a work piece carrier 120 or "holder" is alternately configured to that of FIGS. 1-3, though also provided to magnetically hold one or more work pieces 24. The carrier 120 may be adapted to be conveyed through multiple workstations 28 of an industrial process such as a coating process as in the preceding description. Although not shown, the carrier 120 can include one or more load bars configured to be engaged by a conveyor as part of a conveyor system, e.g., an overhead conveyor and more particularly an indexing conveyor. Thus, the carrier 120 can include one or more conveyor interfaces so that the conveyor can engage and transport the carrier 120. These conveyor interfaces can be provided as horizontal flanges as disclosed above, or may take other forms, e.g., chain interfaces for one or more conveyor chains. For example, the work piece carrier 120 can take the form of the carrier 20 as shown in FIGS. 1-2, with one or more of the structures shown in FIGS. 5-8 replacing the portion between the flanges 36. One or more of the workstations 28 can include liquid baths into which the work pieces 24 and at least a portion of the carrier 120 are immersed during the process of applying a finish coating (e.g., paint) to the work pieces 24. The process can be an electrocoat or "e-coat" process by which electric charge attraction is used to apply suspended paint particles (resin and pigment) from the liquid bath onto the exposed (and electrically conductive) surface of the work pieces 24. In other constructions, the carrier 120 or a modified form thereof may be used in other surface finish or coating processes, such as without limitation, liquid spray paint, powder coating, or electroplating.

The work piece 24 is supported by the carrier 120 in fixed relationship therewith, without any means of clamping, gripping, or grasping. The work piece 24 can be supported "on-edge" along a support surface 140 of the carrier 120. The support surface 140 extends horizontally and forms a bottom surface of the carrier 120 as illustrated, with the work piece 24 suspended from the support surface 140. The support surface 140 of the carrier 120 can cooperate to form one or more predetermined receptacles or locators 142 for receiving a portion of each work piece 24. As illustrated, the locator 142 is formed as a notch, e.g., a 90-degree notch forming an "L" shape (as viewed in the front elevation view of FIG. 7). Thus, the support surface 140 cooperates with an adjacent side surface 140A extending vertically at a right angle with the horizontal bottom support surface 140. In the illustrated construction, the work pieces 24 are coupled to the carrier 120 exclusively by magnetic attraction to the support surface 140. Although the carrier 120 does not clamp or grip the work piece 24 to physically restrain or retain it, the provision of the side surface 140A inhibits or prevents certain movements of the work piece 24 along the horizontal bottom surface 140, such as twisting or swinging.

The carrier 120 has an end cap 146 providing the support surface 140 and the side surface 140A, the end cap 146 separate from one or more magnets 148 provided to magnetically attract and retain the work piece 24. Thus, exposure to process chemical baths and surface wear associated with interaction with the work piece 24 can be limited to the end cap 146 and kept from affecting the magnet 148. The magnet 148 can be a permanent magnet (e.g., Samarium Cobalt Magnet (rated to 572 deg F.)). However, it may be possible in some constructions to provide alternate magnets such electromagnet(s) that can be powered on and off to selectively generate a magnetic field. High temperature magnets 148 may facilitate further conveyance of the work pieces 24 with the carrier 120 through a heated workstation (e.g., an industrial oven or conveyor oven) for drying/curing the applied coating as part of the coating process. Oven temperatures may be in excess of 300 degrees Fahrenheit, and in some constructions up to at least 400 degrees Fahrenheit. The end cap 146 can be constructed partly or entirely of 416 stainless steel or another martensitic stainless steel, which allows transfer of the magnetic field with minimal losses. The end cap 146 is one example of a contact element, separate from the magnet(s) 148, that acts as a magnet-to-work piece intermediary and takes on any surface wear on behalf of the magnet(s) 148.

The magnets 148 can be cylindrical in cross-section. Each magnet 148 can be held in an orientation that defines an attachment location for one or more work pieces 24. The central axis of each cylindrical magnet 148 can be oriented perpendicular to the support surface 140. Thus, the magnetic field is concentrated along a linear path directly below the magnet 148. The work pieces 24, only a portion of which is shown in FIGS. 5-8, are thin elongate parts having a length L, a width W, and a height H and may follow the relationships set forth above. As such, the work pieces 24 are flat or sheet-form. As shown in the drawings, the work piece 24 engages with the surface 140 of the carrier 120 along a thin edge of the work piece 24, while the length L of the work piece 24 extends away from the support surface 140 (e.g., perpendicular). The surface 140A establishes supplementary contact with the surface 140A. The direction of magnetic attraction on the work piece 24 may be axially upward into the surface 140. The work piece 24 may have relatively less magnetic attraction, or none, toward the surface 140A. The width W of the work piece 24 can be less than the corresponding magnet width (e.g., diameter), or as shown, the work piece 24 includes a reduced height tang portion 24A which is the sole point of contact with the carrier 120. For example, the tang portion 24A has a height H1 that is 50 percent or less of the height H elsewhere on the work piece 24. Although the work piece 24 is not shown in full, a vast majority of the length L of the work piece 24 is exposed and stands proud of the end cap 146 (e.g., at least 80 percent, at least 90 percent, or at least 95 percent). An entirety of the work piece length L extends below the support surface 140 (i.e., the horizontal bottom-facing portion thereof). Restraining the work piece 24 to the carrier 120 by magnetic attraction as shown allows the entire remaining surface of the work piece 24 to be exposed to be coated completely and evenly without any touch points. Touch points may be limited to the tang portion 24A, or even a limited portion thereof. In other constructions, the carrier 120 may be provided without the vertical surface 140A such that the only contact point is the thin edge at one lengthwise end of the work piece 24 (e.g., the rear edge of the tang portion 24A having the height and width dimensions H1, W).

The carrier 120 can be used with workstations 28, for example finishing stations including electrocoating immersion tank, an oven, a paint or powder coat spray station, and the like, and reference is hereby made to the preceding description and drawings—although it is repeated that the work piece 24 can in some constructions remain connected to the carrier 120 and otherwise untouched throughout an entire multi-step process. In order to prevent the need for any separate grounding connection placed on the surface of the work pieces 24, the work pieces 24 are grounded through contact with the carrier 120.

Figure 10:
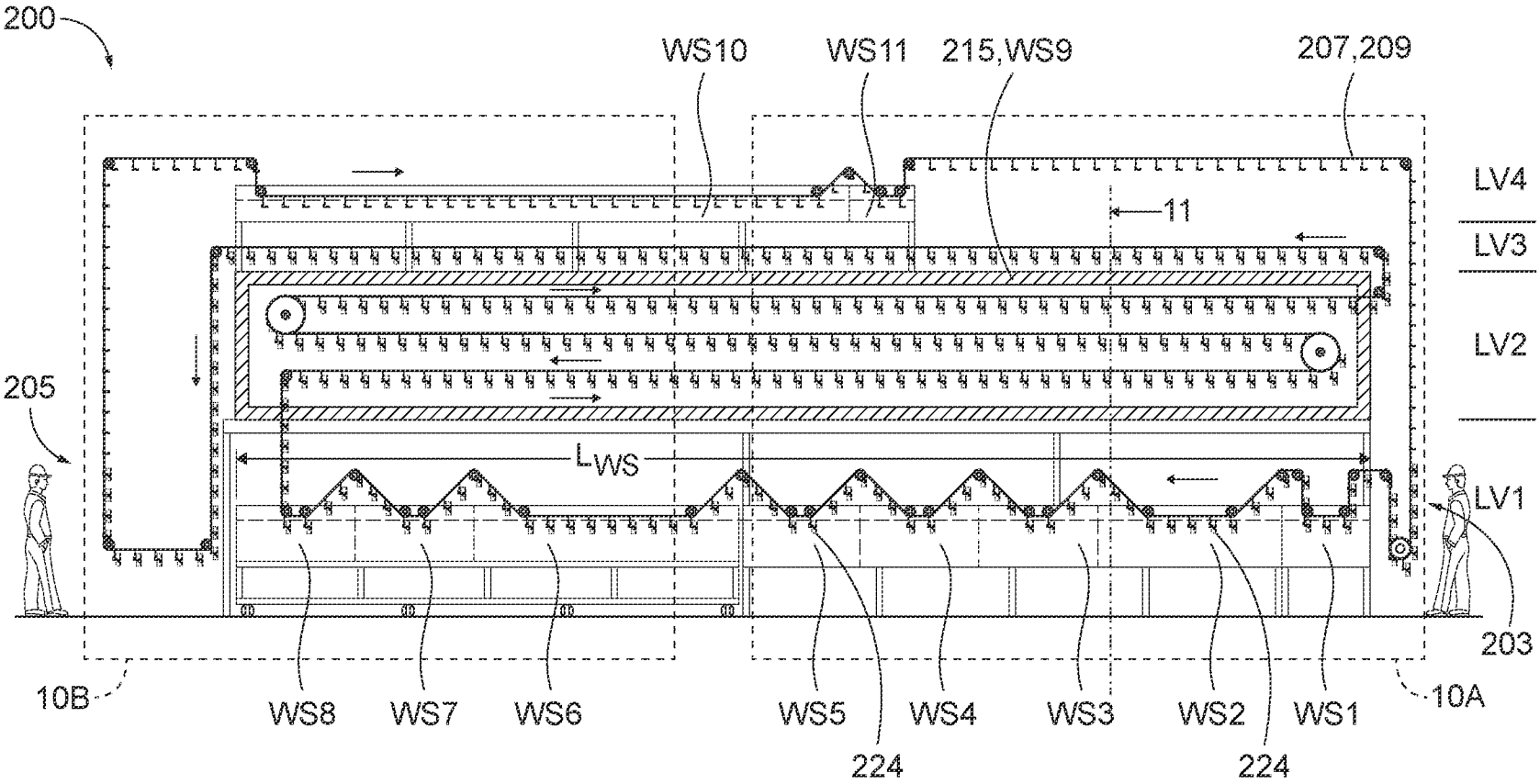
FIG. 10 is a side elevation view of the coating system of FIG. 9.
Figure 11:
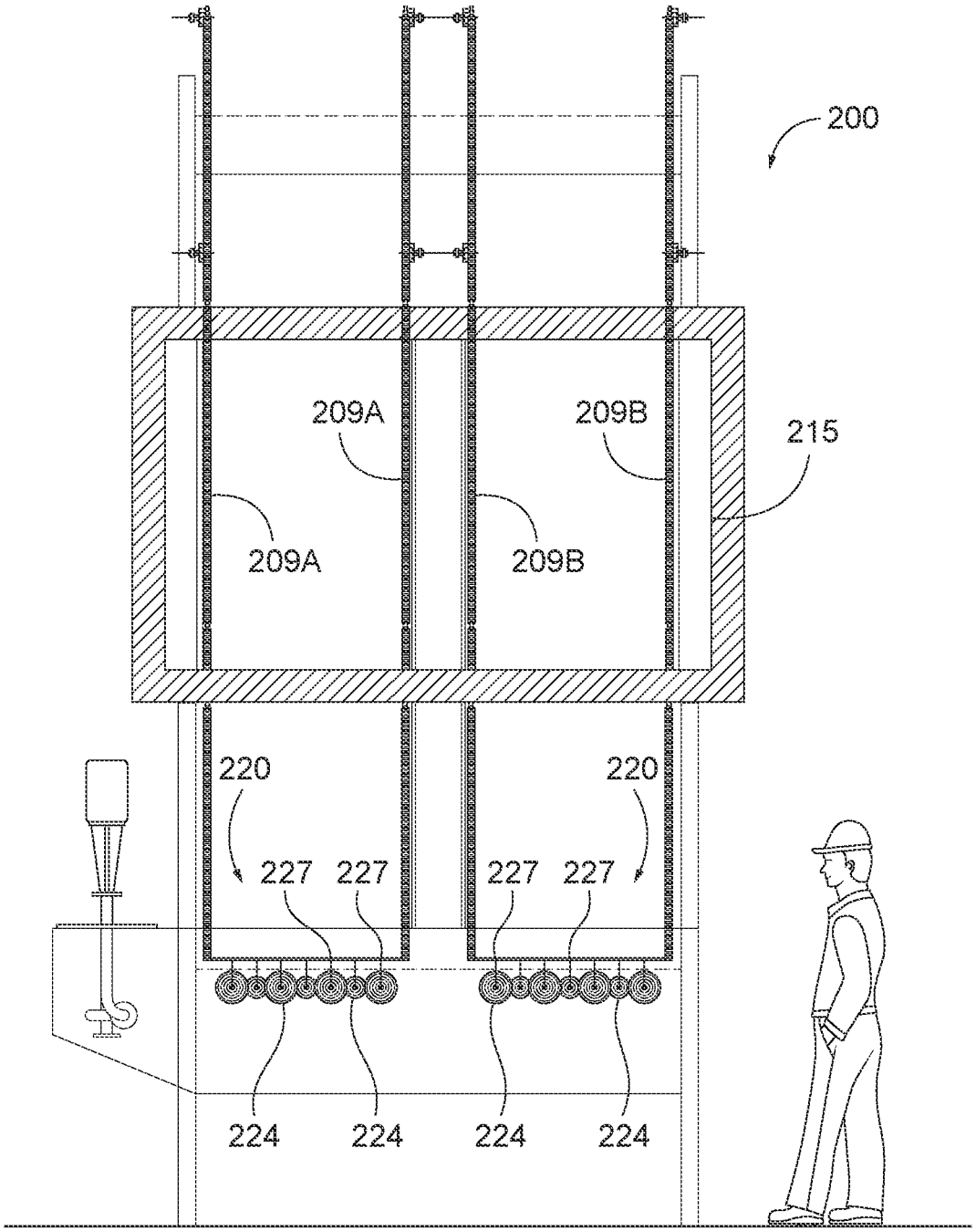
FIG. 11 is a cross-section view of the coating system of FIGS. 9 and 10.
Figure 12:
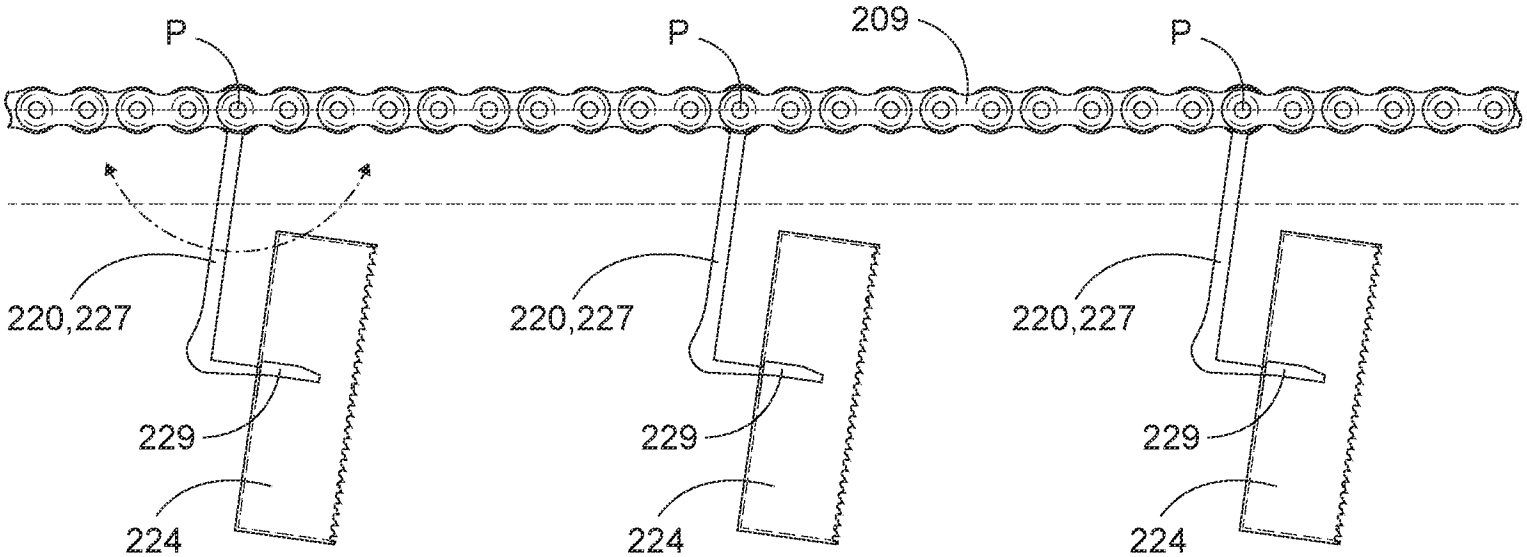
FIG. 12 is a side elevation view of several work piece carriers holding work pieces along a conveyor chain.

FIGS. 9-12 illustrate a work piece coating system 200 according to another aspect of the present disclosure. Although the coating system 200 can take alternate forms and configurations in other constructions, the coating system 200 is illustrated as an electrocoating process that includes several immersion baths, including one for immersing the work pieces 224 into a liquid bath containing suspended, electrically-charged paint particles. As shown in FIG. 12 and described in further detail below, the work pieces 224 can be supported by carriers 220, which differ from those described above. For example, the carriers 220 can be hook-shaped or have hook portions and may support the work pieces 224 by the work pieces 224 resting on or hanging from the hooks rather than by magnetic attraction. Each work piece carrier 220 is coupled to move with movement of the conveyor system 207 at all times. Further the work piece(s) 224 are engaged with their respective carriers 220 for the duration of the process of the system 200—in other words, the carrier 220 maintains possession of the work piece 224 through the full process from a loading station 203 to an unloading station 205.

Figure 9:
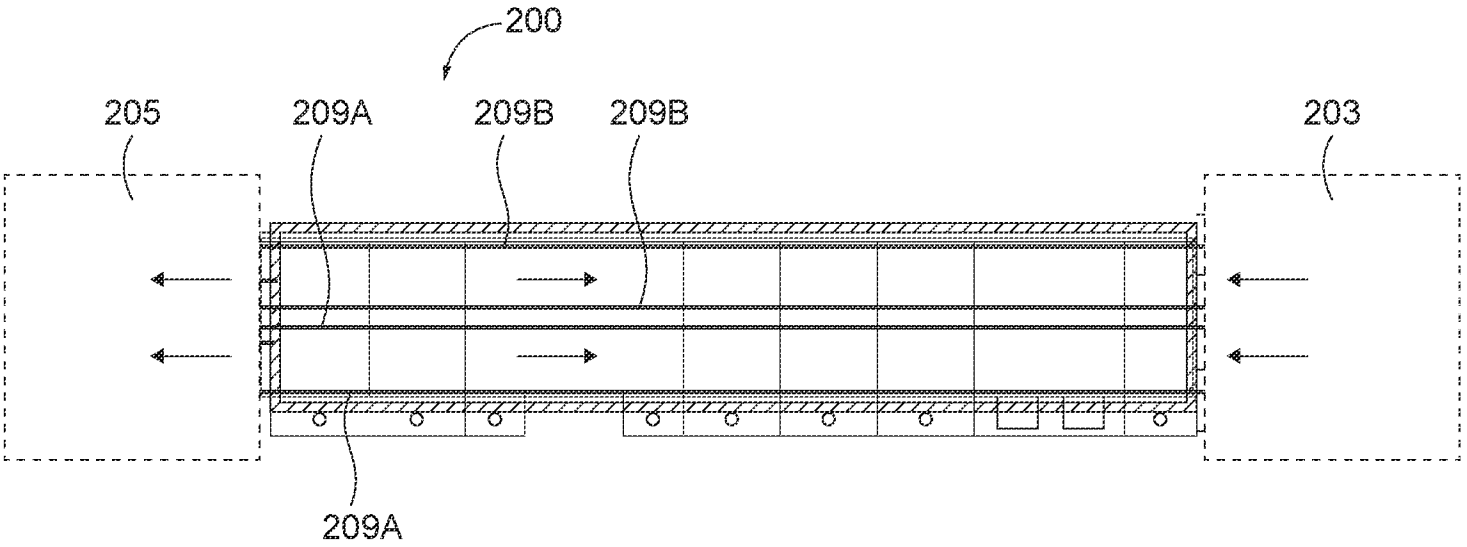
FIG. 9 is a plan view of a coating system according to a third embodiment of the present disclosure.

The work pieces 224 can be thin elongate parts as described above, or differently shaped as in the illustrated construction where the work pieces 224 are hole saws or other components that may be described as round and/or hollow. Returning to FIGS. 9 and 10, the coating system 200 includes opposite first and second ends, the first end having the work piece loading station 203 and the second end having the work piece unloading station 205. As appreciated more clearly from FIG. 10, the work pieces 224 travel a circuitous or serpentine path between the two ends, rather than a single pass from the first end to the second end. The path is defined by a conveyor or conveyor system 207, which is continuous and may be formed in various constructions, including as a chain conveyor in the included drawings. The conveyor system 207 includes one or more conveyor chains 209 and a number of sprockets that direct the conveyor chains 209 around the path and/or power the chain for movement about the path. As can be appreciated from FIG. 9, the conveyor system 207 may include multiple adjacent conveyor tracks, which may be operated independently or synchronously (e.g., from a common drive). If operated with independence, the conveyor system 207 may be said to have multiple conveyors, although the multiple tracks of FIG. 9 are linked together to constitute a single conveyor. As shown, a first conveyor track is defined by a first pair of parallel, laterally spaced conveyor chains 209A, and second conveyor track is defined by a second pair of parallel, laterally spaced conveyor chains 209B. Work pieces 224 on a given one of the conveyor tracks are positioned laterally between the conveyor chains for that conveyor track, e.g., either between the first conveyor chains 209A or between the second conveyor chains 209B. The same may be true for another construction in which there is only a single conveyor track defined by a single pair of conveyor chains 209.

Figure 10A:
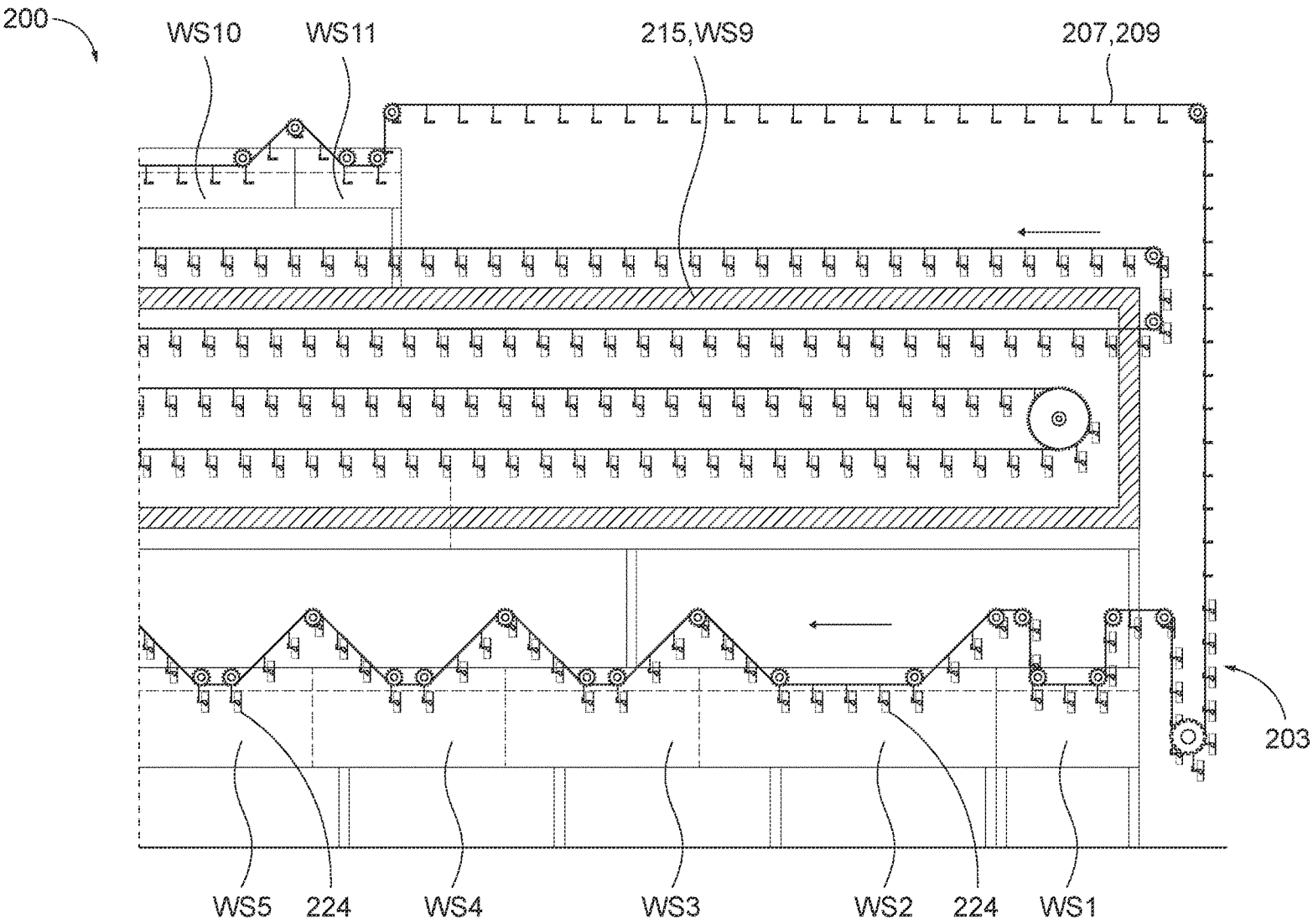
FIG. 10A is a detail view of a portion of the coating system identified in FIG. 10.
Figure 10B:
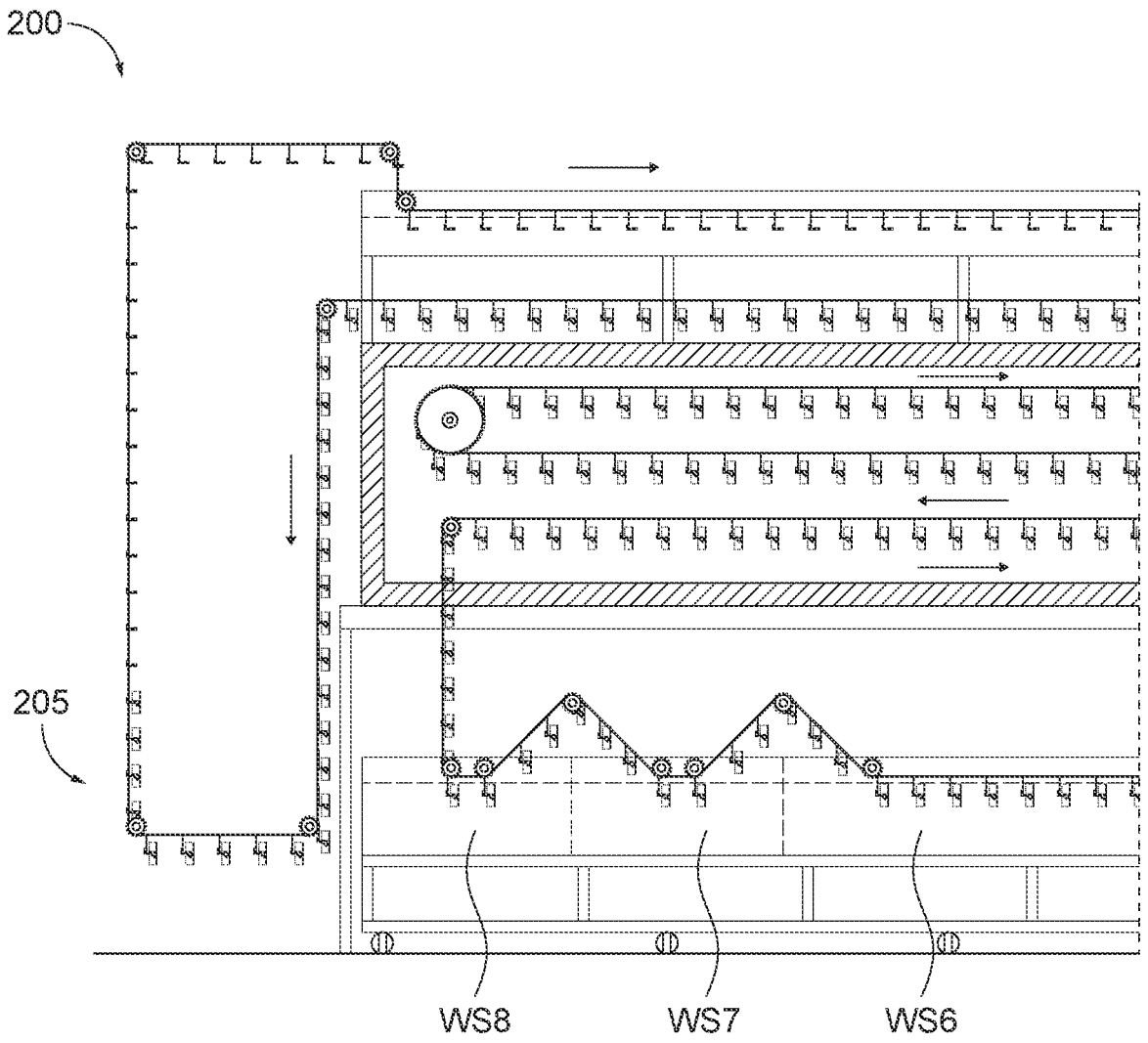
FIG. 10B is a detail view of another portion of the coating system identified in FIG. 10.

From the loading station 203, the work pieces 224 are conveyed through a series or workstations WS to carry out the process (e.g., e-coat). A first group or series of workstations can be arranged at a first level LV1 (FIG. 10) and may include a number of immersion baths. The level refers to vertical height with respect to a floor supporting the workstations, and the first level LV1 may optionally start directly at a floor of an industrial building. The workstations can include some or all of the following in sequence: RO Rinse workstation (WS1), Cleaner workstation (WS2), Counterflow Rinse 1 workstation (WS3), Counterflow Rinse 2 workstation (WS4), Counterflow Rinse 3 workstation (WS5), E-Coat workstation (WS6), Permeate Rinse 1 workstation (WS7), and Permeate Rinse 2 workstation (WS8). The workstation WS1 can be the first workstation of the system 200 to perform any treatment on the work pieces 224 once loaded to the conveyor 207. The workstations WS1-WS8 render coated work pieces, the coating being uncured. FIGS. 10A and 10B show portions of the side elevation in greater detail. From the final workstation WS8 of the first level workstations, the work pieces 224 with uncured coatings applied are conveyed into a cure oven 215 that is positioned at a second level LV2 above the first level LV1. Within the cure oven 215, the conveyor 207 (e.g., each conveyor chain 209 thereof) makes multiple runs or passes so that the work pieces 224 traverse the cure oven 215 multiple times, despite the cure oven 215 as a whole constituting one workstation WS9. The passes of the conveyor 207 can be parallel, back-and-forth passes. In some constructions, the conveyor 207 makes at least three such passes through the cure oven 215. Each pass can be a full-length pass as shown. In addition, the cure oven 215 extends completely or in large part over top of the workstations WS1-WS8 (e.g., arranged directly above rather than offset in plan view). The disclosed configuration increases the residence time of the work pieces 224 within the cure oven 215 without expanding the length of the cure oven 215 so that the plan view footprint of the coating system 200 is minimized and available floor space is preserved. As shown in FIG. 10, the series of workstations WS1-WS8 define a length $L_{WS}$. Measured parallel to the length $L_{WS}$ of these workstations, the cure oven 215 extends the same length $L_{WS}$. More generally, the cure oven 215 has a length no more than 1.1 times the length $L_{WS}$ of the series of workstations WS1-WS8 by which the work pieces 224 come to have the pre-cured applied coating. Moreover, to ensure compact plan view footprint, the respective lengths of the workstations WS1-WS8 and the cure oven 215 can be arranged with at least one completely overlapping the other. In other constructions, at least 90 percent of the length of each is overlapping with the other, referring again to the lengths of the workstations WS1-WS8 and the cure oven 215. For any given conveyor speed, a residence time of any work piece 224 in the cure oven 215 is more than double a total residence time within the series of workstations WS1-WS8. It is also noted that a majority of a plan view width of each of the series of workstations WS1-WS8 and the cure oven 215 are overlapping (FIG. 9), and in some constructions define at least a mutual 90 percent overlap, similar to the description directly above. This results from the conveyor 207 not deviating from a linear path when viewed in plan view (despite the numerous vertical level changes shown in FIG. 10).

The sequential runs of the conveyor 207 through the cure oven 215 can define ascending sub-levels within the second level LV2. As illustrated, the odd number (e.g., three) of serpentine runs through the cure oven 215 result in the work pieces 224 being conveyed out of an outlet of the cure oven 215 at the first end, adjacent the loading station 203 or first end. From the cure oven outlet, the conveyor 207 carries the work pieces 224 back toward the second end and the unloading station 205. This run of the conveyor, which defines a cooling zone or cooling path, is located at a third level LV3 that is above the second level LV2 defined by the cure oven 215 (and may be in fact directly above the cure oven 215). Upon reaching the second end, the conveyor 207 returns the work pieces 224 to the unloading station 205 at the first level LV1. The now empty conveyor 207 returns to the loading station 203 by a conveyor run extending through a fourth level LV4 above all the preceding levels. Along this final return path toward the loading station 203, the carriers 220 can be cleaned at one or more cleaning workstations WS10, WS11 (e.g., paint strip and RO rinse).

Turning now to the cross-section of FIG. 11, it is shown that each carrier 220 can be configured to carry a plurality of like or dissimilar work pieces 224 (e.g., work pieces of the same type but different sizes). The conveyor track on the left supports a first carrier 220 having seven work pieces 224 mounted thereon, and a second carrier 220 on the right conveyor track is similarly loaded. As shown, each carrier 220 forms a laterally extending load bar between the two flanks of its associated conveyor track, e.g., the two chains 209A or the two chains 209B. The carriers 220 can be integrated with the chains 209 or removably attachable. The configuration of the system is configured for very high throughput by combining the advantages of a continuous flow-through monorail system with the concept of two parallel chains and load bars oriented across the transverse axis of the machine. As shown in FIGS. 11 and 12, each carrier 220 includes a plurality of laterally spaced hooks 227, the hooks 227 having barbed ends 229 (FIG. 12). The hollow work pieces 224 are loaded by sliding them over the barbed ends 229 onto the hooks 227. The work pieces 224 are either positively snapped onto the barbed ends 229 or merely passively retained from sliding back off. The barbed hooks 227 allow the work pieces 224 to be retained despite the hooks 227 (or the carriers 220 as a whole) being pivotally supported by the conveyor at respective points P, e.g., by journal bearings. As shown in FIG. 12, the conveyor travels either right or left and the carriers 220 with the hooks 227 are configured to rotate about an axis into the page, perpendicular to the conveyance direction. While this may induce some swinging during operation as shown by the double arrow in FIG. 12, this movement helps assist in liquid drainage and thus the prevention of pooling of the process fluids on the work pieces 224. In some constructions, the hooks 227 may assume a canted attitude when loaded with the work pieces 224 due to the resulting center of gravity. For example, FIG. 12 illustrates the vertical leg of each hook 227 being tilted clockwise several degrees from a straight upright attitude.

The system 200 as shown in FIGS. 9-12 can be used with other types of work pieces and other types of carriers, including but not limited to those of other embodiments contained herein. The system 200 can be operated with one or multiple types of work pieces at a given time, or may be reconfigurable (e.g. by swapping carriers) to accommodate a change in the work pieces.

What is claimed is:

1. A coating process system comprising:

a continuous conveyor;

a first end defining a loading station for loading work pieces to the conveyor;

a second end defining an unloading station for unloading work pieces from the conveyor;

a series of workstations configured to render coated work pieces and arranged at a first level to extend in a row between the first and second ends such that the loading and unloading stations are on opposing sides of the series of workstations; and a cure oven arranged at a second level above the first level, the conveyor having a plurality of serpentine paths between the first and second ends at different sub-levels within the second level, wherein a first post-oven path of the conveyor extends from an outlet of the cure oven to the unloading station, and wherein a second post-oven path of the conveyor extends from the unloading station to the loading station.

2. The coating process system of claim 1, wherein the series of workstations form an electrocoating process line including a liquid bath containing suspended, electrically-charged paint particles.

3. The coating process system of claim 1, further comprising a plurality of carriers coupled to the conveyor for supporting respective work pieces, wherein the plurality of carriers are configured to maintain continuous possession of the respective work pieces from the loading station to the unloading station.

4. The coating process system of claim 1, wherein both the first and second post-oven paths of the conveyor extend above the cure oven, the first post-oven path extending through a third level above the second level, and the second post-oven path extending through a fourth level above the third level.

5. The coating process system of claim 1, further comprising one or more cleaning workstations located along the second post-oven path of the conveyor and configured to clean empty work piece carriers as they are conveyed from the unloading station to the loading station.

6. The coating process system of claim 1, wherein the series of workstations at the first level extend along a linear path between the first and second ends.

7. The coating process system of claim 1, further comprising a plurality of carriers, each of the plurality of carriers adapted to carry a plurality of work pieces across a direction transverse to a direction of travel of the conveyor.

8. The coating process system of claim 7, wherein each of the plurality of carriers spans between a first pair of separate, laterally-spaced conveyor chains of the conveyor to act as a lateral load bar for the plurality of work pieces.

9. The coating process system of claim 8, further comprising an additional plurality of carriers, each adapted to carry a plurality of work pieces across the transverse direction, each of the additional plurality of carriers spanning between a second pair of separate, laterally-spaced conveyor chains of the conveyor.

10. A coating process system comprising:

a continuous conveyor;

a series of workstations configured to prepare and coat a work piece suspended from the conveyor extending along the series of workstations, wherein the series of workstations extend to define a row with an upstream end and an opposite downstream end;

a loading station at which the work piece is coupled to the conveyor at the upstream end of the series of workstations;

a cure oven having an inlet and an outlet, wherein the inlet is located adjacent to the downstream end of the series of workstations along the conveyor, the cure oven extending above the series of workstations, the conveyor having a plurality of sequential, back-and-forth paths where each path extends across the cure oven at a different height;

an unloading station at which the work piece is removed from the conveyor adjacent to the downstream end of the series of workstations; and a post-oven path of the conveyor extending from the outlet of the cure oven to the unloading station and from the unloading station to the loading station.

11. The coating process system of claim 10, wherein the post-oven path of the conveyor extends over top of the cure oven.

12. The coating process system of claim 10, wherein a length of the cure oven is no more than 1.1 times a length of the series of workstations between the upstream and downstream ends.

13. The coating process system of claim 10, wherein the plurality of sequential, back-and-forth paths of the conveyor across the cure oven includes at least three paths.

14. The coating process system of claim 10, wherein the series of workstations form an electrocoating process line including a coating station in which a liquid bath contains suspended, electrically-charged paint particles.

15. The coating process system of claim 10, further comprising a carrier coupled to the conveyor for supporting the work piece, the carrier configured to maintain continuous possession of the work piece from the loading station to the unloading station.

16. The coating process system of claim 15, wherein the carrier spans between a pair of separate, laterally-spaced conveyor chains of the conveyor to act as a lateral load bar for a plurality of work pieces including the work piece.

17. The coating process system of claim 10, wherein the outlet of the cure oven is located at a common end of the coating process system as the loading station, the coating process system further having an additional post-oven conveyor path extending over top of the cure oven from the cure oven outlet to the unloading station.

18. The coating process system of claim 10, further comprising one or more cleaning workstations located along the post-oven path of the conveyor and configured to clean empty work piece carriers as they are conveyed from the unloading station to the loading station.

19. The coating process system of claim 10, wherein the series of workstations extend along a linear path between the upstream and downstream ends.

20. A coating process system comprising:

a continuous conveyor;

a series of workstations arranged along a path of the conveyor and configured to prepare and coat a work piece carried by the conveyor, the series of workstations defining a length measured between respective upstream and downstream ends thereof;

a cure oven having an inlet located adjacent the downstream end of the series of workstations along the conveyor, the cure oven extending over top of the series of workstations, wherein, measured parallel to the length of the series of workstations, the cure oven defines a length no more than 1.1 times the length of the series of workstations; and one or more cleaning workstations located along a post-oven path of the conveyor over top of the cure oven and configured to clean an empty work piece carrier as it is conveyed from an unloading station to a loading station adjacent the upstream end of the series of workstations, wherein the conveyor has at least three lengthwise paths through the cure oven at different heights such that, for any given conveyor speed, a residence time of the work piece in the cure oven is more than double a total residence time within the series of workstations.

21. The coating process system of claim 20, wherein an additional post-oven path of the conveyor extends over top of the cure oven to deliver the work piece from an outlet of the oven to the unloading station.

22. The coating process system of claim 20, wherein the carrier is configured to maintain continuous possession of the work piece throughout a full cycle of the coating process system.

23. The coating process system of claim 22, wherein the carrier spans between a pair of separate, laterally-spaced conveyor chains of the conveyor to act as a lateral load bar for a plurality of work pieces including the work piece.

24. The coating process system of claim 20, wherein the series of workstations form an electrocoating process line including a coating station in which a liquid bath contains suspended, electrically-charged paint particles.

25. The coating process system of claim 20, wherein the series of workstations extend along a linear path between the upstream and downstream ends.

* * * * *